US006289691B1

(12) United States Patent
Kim et al.

(10) Patent No.: US 6,289,691 B1
(45) Date of Patent: Sep. 18, 2001

(54) REFRIGERATOR

(75) Inventors: Kwang-Il Kim, Kwangju; Sung-Cheol Kang; Eui-Joon Kim, both of Suwon, all of (KR)

(73) Assignee: Samsung Electronics Co., Ltd, Suwon (KR)

( * ) Notice: Subject to any disclaimer, the term of this patent is extended or adjusted under 35 U.S.C. 154(b) by 0 days.

(21) Appl. No.: 09/450,681

(22) Filed: Nov. 30, 1999

(30) Foreign Application Priority Data

Dec. 1, 1998 (KR) ..... 98-52205

(51) Int. Cl.[7] ..... F25B 41/00
(52) U.S. Cl. ..... 62/513
(58) Field of Search ..... 62/513, 113

(56) References Cited

U.S. PATENT DOCUMENTS 2,580,442 * 1/1952 Kogel ..... 62/119.5
5,092,138 * 3/1992 Radermacher et al. ..... 62/502
5,207,077 5/1993 Radermacher et al. .
5,235,820 8/1993 Radermacher et al. .
5,243,837 9/1993 Radermacher et al. .
5,406,805 4/1995 Radermacher et al. .
5,457,966 * 10/1995 Nivens ..... 62/513
5,960,642 * 10/1999 Kim et al. ..... 62/513

* cited by examiner

*Primary Examiner*—William E. Tapolcai
*Assistant Examiner*—Mohammad M Ali
(74) *Attorney, Agent, or Firm*—Larson & Taylor PLC

(57) ABSTRACT

A refrigerator includes a compressor, a condenser for condensing a refrigerant supplied from the compressor, and a pair of evaporators which are connected in series for evaporating the refrigerant supplied from the condenser. The refrigerator further includes a connection refrigerant tube connecting the pair of evaporators, and an intercooler refrigerant tube extended from the condenser and contacting the outer surface of the connection refrigerant tube for heat-exchanging with the connection refrigerant tube. Accordingly, a tube connection work is facilitated and a refrigerant leakage possibility is lowered.

12 Claims, 5 Drawing Sheets

FIG. 4

| ITEM | | CONVENTIONAL ART | EMBODIMENT |
|---|---|---|---|
| RUNNING RATE | CYCLE TIME | 41.5 min | 40.1 min |
| | RUNNING TIME | 24.9 min | 23.2 min |
| | PAUSING TIME | 16.6 min | 16.9 min |
| | CYCLE NUMBER PER HOUR | 1.45 times | 1.50 times |
| | Rr | 60.1 % | 57.9 % |
| POWER CONSUMP-TION | DAILY | 1.416 kw | 1.377 kw |
| | MONTHLY AVERAGE | 43.1 kw | 41.9 kw |
| | SAVING RATE | reference value | 2.9% |

REFRIGERATOR

BACKGROUND OF THE INVENTION

The present invention relates to a refrigerator, and more particularly to a refrigerator which contains a heat exchanger which mates an outer surface of a connection refrigerant tube between a food compartment evaporator and a freezer compartment evaporator with an outer surface of an intercooler refrigerant tube extended from a condenser.

A refrigerator including an intercooler refrigerating system which exchanges heat between a refrigerant tube extended from one region of a condenser with that of a refrigerant tube in an evaporator is known. With this refrigerator, subcooling of the condensed refrigerant and increasing of the temperature of the refrigerant flowing back to a compressor is achieved.

FIG. 5 shows a configuration of a refrigerator having a conventional intercooler refrigerating system. As depicted, the conventional refrigerating system includes a compressor 51 installed on the lower rear side of the main body of the refrigerator, a condenser 53 formed of a condenser tube 54 disposed over the whole region of the main body, a capillary tube 55 for expanding the refrigerant, a food compartment evaporator 58 for evaporating the refrigerant and cooling a food compartment, and a freezer compartment evaporator 57 for evaporating the refrigerant and cooling a freezer compartment.

The freezer compartment evaporator 57 and the food compartment evaporator 58 are connected in series to each other so that the refrigerant flows from the freezer compartment evaporator 57 to the food compartment evaporator 58. As shown in FIG. 6, the food compartment evaporator 58 is comprised of a plurality of heat transfer fins 63 which are disposed with spaces therebetween of a certain distance and a refrigerant tube which serpentines through the heat transfer fins 63.

The refrigerant tube of the food compartment evaporator 58 is formed of an inner tube 60 having a predetermined small diameter and an outer diameter tube 62 next to the outer surface of the inner tube 60, as particularly shown in FIG. 7. The inlet or entrance of a connection refrigerant tube 59 is connected to the freezer compartment evaporator 57 and the outlet or exit of the connection refrigerant tube 59 is connected to the inlet of the outer tube 62 of the food compartment. The condenser tube 54 extended from the condenser 53 is soldered at the entrance of the inner tube 60 of the food compartment. The connecting tube 65 is connected to the outlet of the outer tube 62 and to the inlet of compressor 51. Finally, the inlet of the capillary tube 55 is connected to the outlet inner tube 60.

Thus, the refrigerant tube in the food compartment evaporator 58 is comprised of the outer tube 62 and the inner tube 60 which are extruded integrally. The refrigerant supplied from the freezer compartment evaporator 57 flows through the outer tube 62 and the refrigerant supplied from the condenser 53 flows through the inner tube 60. Thus, the refrigerant flowing through the inner tube 60 flows in the opposite direction to that flowing through the outer tube 62.

When the refrigerating system operates, the refrigerant compressed in the compressor 51 flows into the condenser 53 and is condensed while flowing through the condenser tube 54. The refrigerant flowing through the condenser tube 54 flows into the inner tube 60 of the refrigerant tube in the food compartment evaporator 58. The refrigerant flowing through the inner tube 60 is in heat exchange with the refrigerant flowing through the outer tube 62 thereof. Thus, the refrigerant flowing through the inner tube 60 is subcooled by the refrigerant in outer tube 62 before being discharged to the refrigerant tube connected to the capillary tube 55. Then, the refrigerant is expanded through the capillary tube 55. The expanded refrigerant flows into the freezer compartment evaporator 57. Low temperature refrigerant flowing into the freezer compartment evaporator 57 is in heat exchange with the freezer compartment, thereby increasing the temperature of the refrigerant. Then, the refrigerant flows into the outer tube 62 in the food compartment evaporator 58. The refrigerant flowing through the outer tube 62 receives heat from the refrigerant flowing through the inner tube 60, thereby increasing the temperature of the refrigerant in outer tube 62. Then, the refrigerant in outer tube 62 flows back to the compressor 51 through the compressor tube 65.

In the above refrigerating system, heat exchange between the refrigerant flowing through the inner tube 60 in the refrigerant tube for the food compartment evaporator 58 and the refrigerant flowing through the outer tube 62 therein is achieved. It will be appreciated that the temperature of the refrigerant flowing through the inner tube 60 decreases; as a result, a condensation efficiency of the refrigerant increases. In addition, the refrigerant flowing through the outer tube 62 flows into the compressor 51 after its temperature increases, thus preventing damage to the compressor 51.

Meanwhile, the condenser tube 54 is connected to the inner tube 60 of the food compartment evaporator 58, and the connection refrigerant tube 59 and the compressor tube 65 are connected to the outer tube 62 thereof. The inner tube 60 and the outer tube 62 have smaller diameters than that of the condenser tube 54, the connection refrigerant tube 59 and the compressor tube 65. Thus, in order to connect the inner tube 60 and the outer tube 62 to their respective tubes, both ends of the inner tube 60 and the outer tube 62 should be expanded in their diameters sufficiently so as to be suitable to the diameters of the corresponding tubes.

However, since the inner tube 60 and the outer tube 62 are extruded integrally, it is not so easy to expand the diameters of the inner tube 60 and the outer tube 62. As a pair of connection points exists at both ends of the inner tube 60 and the outer tube 62, working ability deteriorates and the refrigerant leakage possibility increases.

To conserve energy and improve efficiency of the system, U.S. Pat. No. 5,243,837 (Radermacher) discloses a subcooling system for a refrigeration cycle of a multi-compartment refrigeration apparatus. In this apparatus, the heat exchange relationship can be effected by an internal subcooler in which nonazeotropic working fluid leaving the condenser is directed though a conduit within the tube of a fin-tube evaporator, the conduit being of smaller dimension than the tube of the evaporator. U.S. Pat. No. 5,406,805 (Radermacher) discloses a tandem refrigeration system which can reliably cool two or more compartments economically and efficiently. This is accomplished by operating the system with a single compressor, providing two evaporators in series, operating the evaporators at the same pressure level at any given time, and operating only one evaporator fan at a time. However, such systems still have the problem of working ability deterioration and of refrigerant leakage possibility as described above.

BRIEF SUMMARY OF THE INVENTION

To solve the above problems, it is an object of the present invention to provide a refrigerator in which a tubing work is facilitated and a refrigerant leakage possibility decreased while maintaining a high efficiency of a refrigerating system.

To accomplish the above object of the present invention, there is provided a refrigerator including a compressor, a condenser for condensing a refrigerant supplied from said compressor, and a pair of evaporators which are connected in series for evaporating the refrigerant supplied from the condenser. The refrigerator also includes: a connection refrigerant tube connecting the pair of evaporators; and an intercooler refrigerant tube extended from said condenser and contacting the outer surface of the connection refrigerant tube for heat-exchanging with the connection refrigerator tube.

Preferably, said intercooler refrigerant tube and said connection refrigerant tube are in parallel contact with each other.

Preferably, the length of said connection refrigerant tube is about 1.4 to 2.2 meters.

Preferably, said intercooler refrigerant tube is connected to an exit of said condenser.

Preferably, said intercooler refrigerant tube has a diameter smaller than that of said refrigerant tube in the condenser.

Preferably, said intercooler refrigerant tube has a diameter smaller than that of said connection refrigerant tube.

Preferably, said intercooler refrigerant tube is disposed so that the refrigerant in the refrigerant tube can flow in the opposite direction to that of the refrigerant in said connection refrigerant tube.

Preferably, a space between said intercooler refrigerant tube and said connection refrigerant tube is surrounded with a foam material.

Also, preferably, said intercooler refrigerant tube encloses the outer surface of said connection refrigerant tube in a spiral form.

BRIEF DESCRIPTION OF THE DRAWINGS

The objects and other advantages of the present invention will become more apparent by describing the structures and operations of the present invention in detail referring to the accompanying drawings, in which:

FIG. 4 is a table in which an energy efficiency is compared between the refrigerating system of the present invention and the conventional intercooler refrigerating system;

DETAILED DESCRIPTION OF THE INVENTION

Preferred embodiments of the present invention will be described in detail referring to the accompanying drawings.

Figure 1:
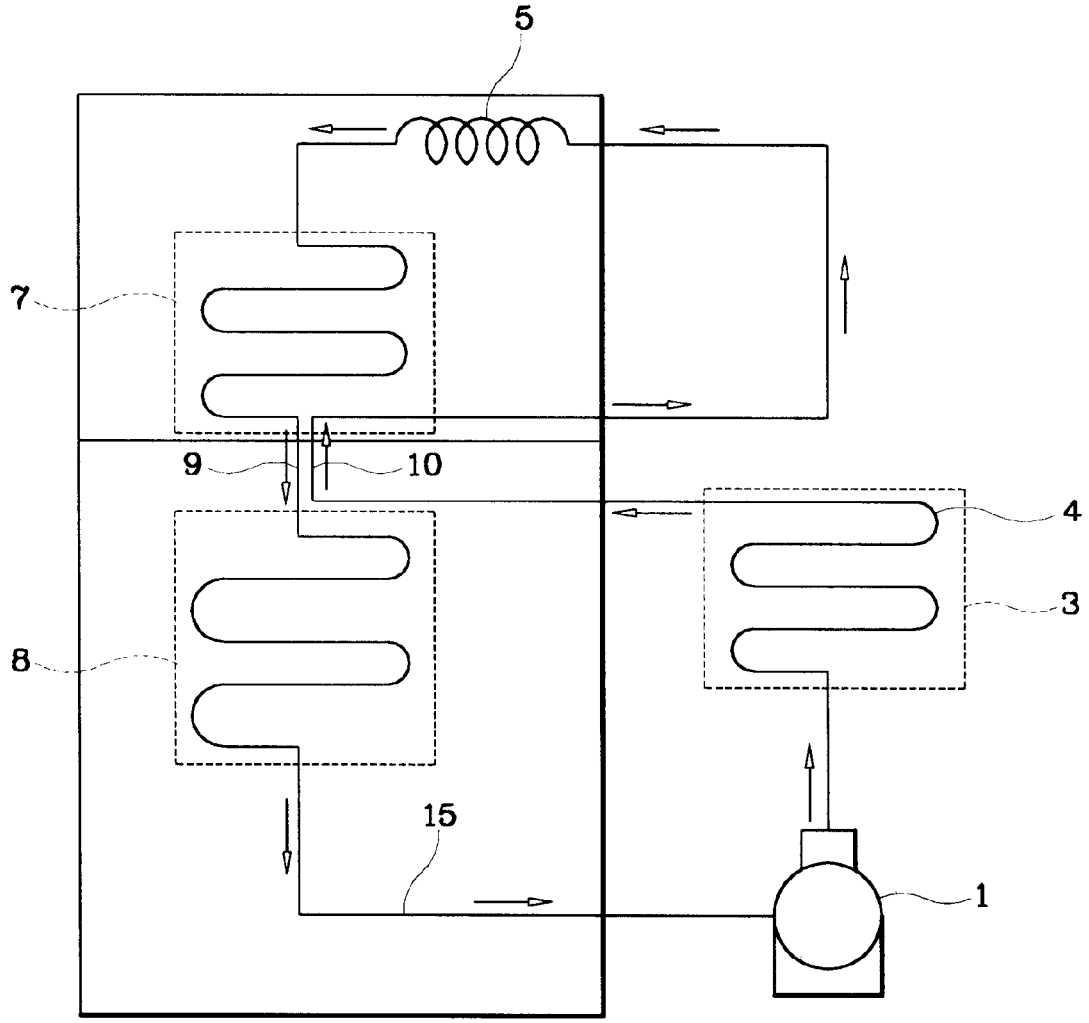
FIG. 1 shows a configuration of a refrigerator having an intercooler refrigerating system according to the present invention.

Referring to FIG. 1, a refrigerating system used in a refrigerator according to the present invention is comprised of (a) a compressor 1 for compressing a refrigerant at high temperature and at high pressure, (b) a condenser 3 formed of condenser tube 4 which are disposed over the whole region, for condensing the refrigerant, (c) a capillary tube 5 for expanding the refrigerant, and (d) a food compartment evaporator 8 and a freezer compartment evaporator 7 for evaporating the refrigerant and cooling a food compartment and a freezer compartment. Here, said food compartment evaporator 8 and said freezer compartment evaporator 7 are connected to each other by a connection refrigerant tube 9. Said food compartment evaporator 8 and said compressor 1 are connected to each other by a compressor tube 15.

Figure 2:
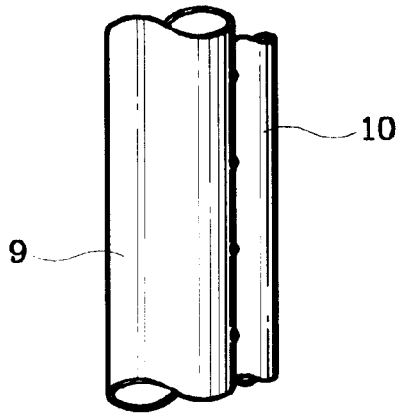
FIG. 2 is a partial side view of a portion of a connection refrigerant tube according to an embodiment of FIG. 1.
Figure 3:
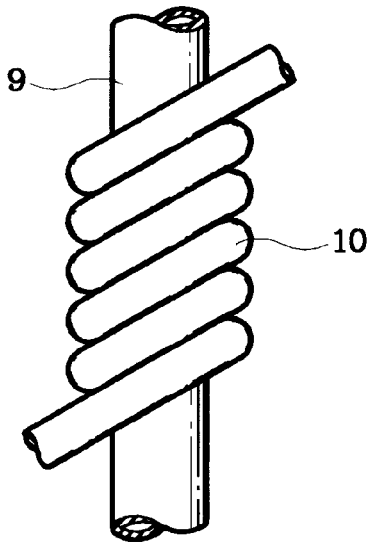
FIG. 3 is a partial side view of a portion of a connection refrigerant tube according to another embodiment of FIG. 1.
Figure 5:
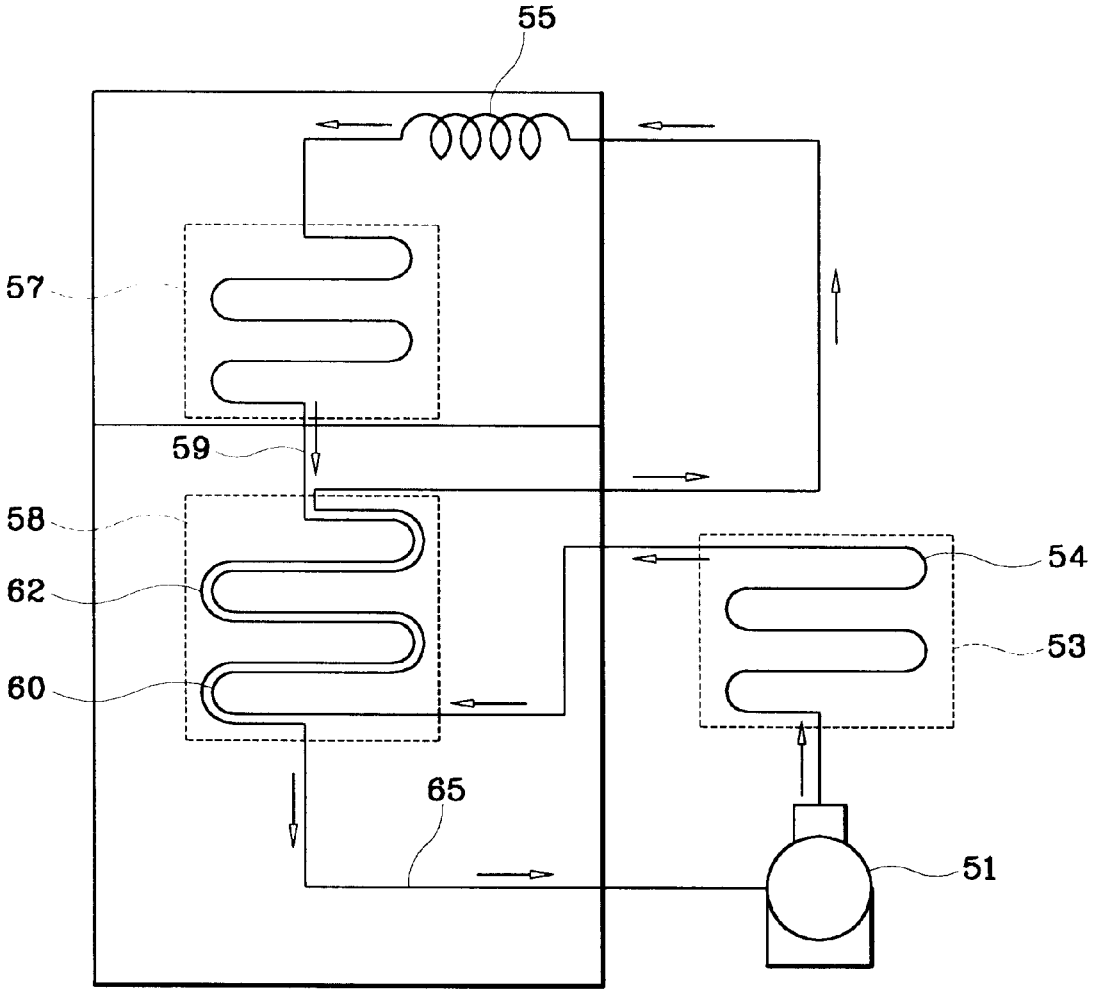
FIG. 5 (PRIOR ART)
FIG. 5 shows a configuration of a refrigerator having a conventional intercooler refrigerating system.
Figure 6:
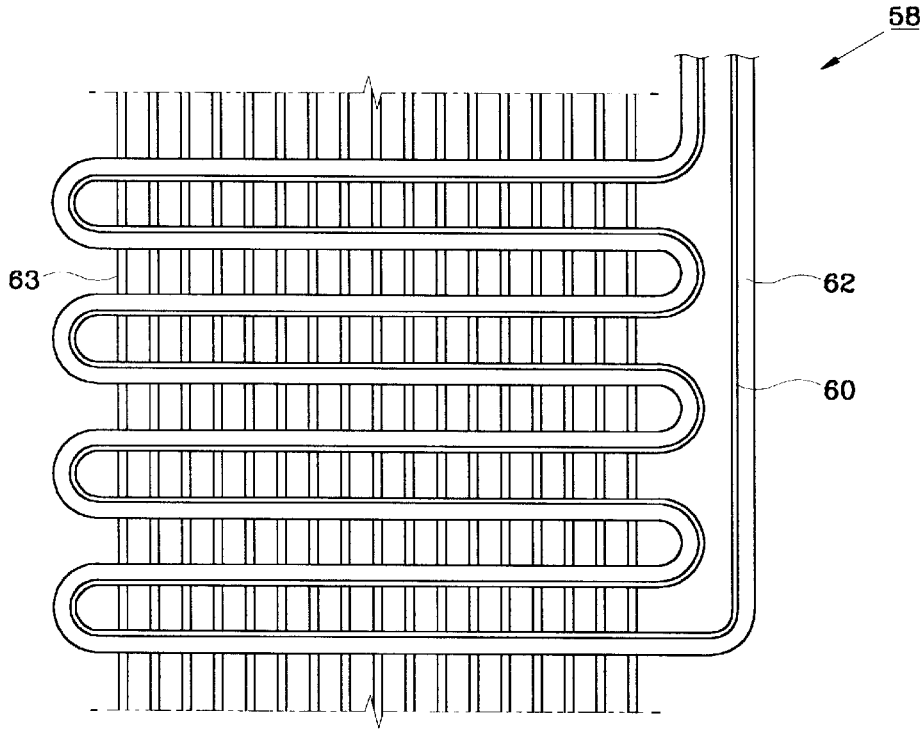
FIG. 6 (PRIOR ART)
FIG. 6 is a side view of an evaporator of FIG. 5.
Figure 7:
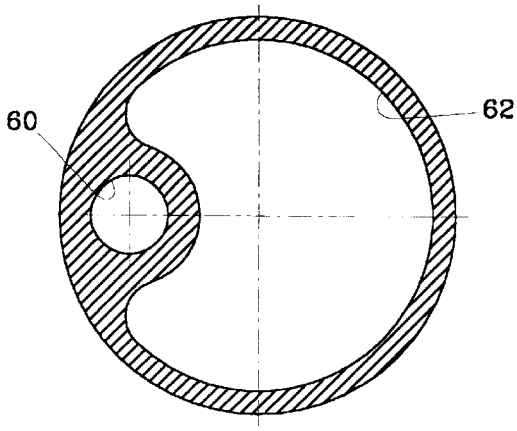
FIG. 7 (PRIOR ART)
FIG. 7 is a cross-section view of the refrigerant tube in the evaporator of FIG. 6.

An intercooler refrigerant tube 10 is extended from the outlet or exit of said condenser tube 4 toward the connection refrigerant tube 9, in which the diameter of said refrigerant tube 10 is reduced relative to that of the connection refrigerant tube 9. Said refrigerant tube 10 is configured to contact the whole surface of said connection refrigerant tube 9. As shown in FIGS. 2 and 3, said refrigerant tube 10 and said connection refrigerant tube 9 are installed so that a heat exchange is sufficiently performed. For this purpose, said connection refrigerant tube 9 is extended in the longitudinal direction as shown in FIG. 2, or said refrigerant tube 10 is serpentine to surround the outer surface of the connection refrigerant tube 9 as shown in FIG. 3. In the case that said refrigerant tube 10 and said connection refrigerant tube 9 are combined in parallel, it is preferable that said connection refrigerant tube 9 is about 1.4 to 2.2 meters long although that of the conventional refrigerant tube is about 0.6 to 0.8 meters. Said refrigerant tube 10 and said connection refrigerant tube 9 can be mutually welded so that heat can be directly exchanged.

Said refrigerant tube 10 is fixed to said connection refrigerant tube 9 so that the direction of the refrigerant flowing through said refrigerant tube 10 is opposite to that of the refrigerant flowing through said connection refrigerant tube 9. It will be appreciated that the inlet or entrance of said refrigerant tube 10 is adjacent to said food compartment evaporator 8 and the outlet or exit thereof is adjacent to said freezer compartment evaporator 7. A foaming material is hardened so that said refrigerant tube 10 and said connection refrigerant tube 9 are integrally fixed in the space between an inner case and an outer case of the refrigerator.

When the present refrigerating system operates, said compressor 1 compresses the refrigerant at high temperature and at high pressure. The compressed refrigerant flows into said condenser 3 and is condensed while flowing through said condenser tube 4. The refrigerant flowing through said condenser tube 4 then flows into said refrigerant tube 10, where heat of the refrigerant flowing through said refrigerant tube 10 is mutually exchanged with that of the refrigerant flowing through said connection refrigerant tube 9 and is thus subcooled.

Then, the refrigerant passing through said refrigerant tube 10 passes through the connecting refrigerant tube and is expanded while passing through said capillary tube 5. The expanded refrigerant flows into said freezer compartment evaporator 7 and is heat-exchanged with the air in the freezer compartment. The heat-exchanged refrigerant then flows through said connection refrigerant tube 9. The refrigerant flowing through said connection refrigerant tube 9 is heat-exchanged with that flowing through said refrigerant tube 10. The refrigerant in refrigerant tube 9 whose temperature increases through heatexchange with the refrigerant tube 10 then flows into the food compartment evaporator 8 and is heat-exchanged with the air in the food compartment. Finally, the heat exchanged refrigerant flows through said compressor tube 15 and back into the compressor 1.

According to the present invention, an inner tube and an outer tube are not formed in said food compartment evaporator 8 as in the conventional case. However, a portion (tube 10) of said condenser tube 4 contacts said connection refrigerant tube 9 so that the refrigerant flowing through said connection refrigerant tube 9 and said refrigerant tube 10 are heat-exchanged with each other. As in the conventional case, the condensation efficiency of said condenser 3 is enhanced and damage of said compressor 1 can be prevented.

Since the diameters of said inner and outer tubes are longer than the conventional food compartment evaporator 8, it is not so easy to connect the inner and outer tubes with their respective refrigerant tube. However, according to the present invention, since said food compartment evaporator 8 has a refrigerant tube forming a single path, said connection refrigerant tube 9 and said compressor tube 15 can be conveniently connected thereto. Also, since the connection points of the refrigerant tube of said food compartment evaporator 8 to said connection refrigerant tube 9 and said compressor tube 15 are reduced, the refrigerant is unlikely to leak.

The table of FIG. 4 compares the energy efficiency of the present invention and that of the conventional refrigerating system. The energy efficiency in the present embodiment is measured on the condition that said connection refrigerant tube 9 has a length of about 1.8 meters, and said refrigerant tube 10 and said connection refrigerant tube 9 are welded in parallel.

As illustrated in FIG. 4, in the conventional refrigerating system, since the running time of said compressor 51 is 24.9 minutes and the pausing time of said compressor 51 is 16.6 minutes, the total time of one cycle is 41.5 minutes. Comparatively, in said refrigerating system of the present invention, since the running time of said compressor 1 is 23.2 minutes and the pausing time of said compressor 1 is 16.9 minutes, the total time of one cycle is 40.1 minutes. Thus, in the conventional refrigerating system, a ratio Rr of the running time of said compressor 51 to the total time of cycle is 60.1%, while in the present refrigerating system, the Rr is 57.9%. As a result, the running time of said compressor 1 is reduced, in comparison with the conventional case, thus the running efficiency enhancement can be achieved.

Also, in terms of power consumption, an amount of monthly power consumption of the conventional refrigerating system is 43.1 kWh/m. However, an amount of monthly power consumption of the refrigerating system according to the present invention is 41.9 kWh/m. Thus, the present invention can save power consumption at about 2.9%.

As described above, since said refrigerant tube 10 extended from said condenser tube 4 contacts said connection refrigerant tube 9 in the present refrigerating system, an energy efficiency obtained from the conventional refrigerating system is maintained and a tube connection work during fabrication of the refrigerating system is facilitated. Also, a refrigerant leakage possibility is lowered.

In the above-described embodiment, the refrigerating system is configured so that the refrigerant condensed during passing through the condenser 3 flows into said freezer compartment evaporator 7. However, a refrigerating system according to the present invention can be configured so that the refrigerant flowing out from said condenser 3 flows into a food compartment evaporator 8.

As described above, the present invention provides a refrigerator having a refrigerating system in which a tube connection work is facilitated and a refrigerant leakage possibility is lowered.

Although the present invention has been described in connection with preferred embodiments thereof, it will be appreciated by those skilled in the art that additions, modifications, substitutions and deletions not specifically described may be made without department from the spirit and scope of the invention as defined in the appended claims.

What is claimed is:

1. A refrigerator including:

a compressor;

a condenser for condensing a refrigerant supplied from the compressor;

a pair of evaporators which are connected in series for evaporating the refrigerant supplied from the condenser;

a connection refrigerant tube connecting said pair of evaporators with each other; and an intercooler refrigerant tube extended from said condenser and contacting the outer surface of the connection refrigerant tube for heat-exchanging with said connection refrigerant tube; and wherein a space between said intercooler refrigerant tube and said connection refrigerant tube is surrounded with a foam material.

2. The refrigerator according to claim 1, wherein said intercooler refrigerant tube and said connection refrigerant tube are in parallel contact with each other.

3. The refrigerator according to claim 2, wherein said connection refrigerant tube is about 1.4 to 2.2 meters long.

4. The refrigerator according to claim 2, wherein said intercooler refrigerant tube is connected to an exit of said condenser.

5. The refrigerator according to claim 4, wherein said refrigerant tube has a diameter smaller than that of said refrigerant tube in said condenser.

6. The refrigerator according to claim 5, wherein said intercooler refrigerant tube has a diameter smaller than that of said connection refrigerant tube.

7. The refrigerator according to claim 6, wherein said intercooler refrigerant tube is disposed so that the refrigerant in said refrigerant tube flows in an opposite direction to that of the refrigerant in said connection refrigerant tube.

8. The refrigerator according to claim 1, wherein said intercooler refrigerant tube is continuous and includes a portion which encloses an outer surface of said connection refrigerant tube in a spiral form.

9. The refrigerator according to claim 8, wherein said intercooler refrigerant tube is connected to an exit of said condenser.

10. The refrigerator according to claim 9, wherein said intercooler refrigerant tube has a diameter smaller than that of said refrigerant tube in the condenser.

11. The refrigerator according to claim 10, wherein said intercooler refrigerant tube has a diameter smaller than that of said connection refrigerant tube.

12. The refrigerator according to claim 11, wherein said refrigerant tube is disposed so that the refrigerant in said refrigerant tube flows in an opposite direction to that of the refrigerant in said connection refrigerant tube.

* * * * *